US006546661B1

(12) United States Patent
Staubs

(10) Patent No.: US 6,546,661 B1
(45) Date of Patent: Apr. 15, 2003

(54) GUN MOUNTED SPRAYER

(76) Inventor: William Staubs, 1816 N. Dixie Hwy., Ft. Lauderdale, FL (US) 33305

( * ) Notice: Subject to any disclaimer, the term of this patent is extended or adjusted under 35 U.S.C. 154(b) by 0 days.

(21) Appl. No.: 09/997,050

(22) Filed: Nov. 20, 2001

(51) Int. Cl.[7] ..... F41C 27/06
(52) U.S. Cl. ..... 42/1.08; 102/367
(58) Field of Search ..... 42/1.08, 90; 89/1.2; 102/367

(56) References Cited

U.S. PATENT DOCUMENTS 3,841,526 A * 10/1974 Haskins
5,531,359 A * 7/1996 Winner ..... 222/153.11
5,581,898 A * 12/1996 Thummel ..... 42/103
5,671,559 A * 9/1997 Ludaesher et al. ..... 42/1.08
5,787,628 A * 8/1998 Teetzel ..... 42/1.08
5,983,548 A * 11/1999 Ludaesher ..... 42/90

FOREIGN PATENT DOCUMENTS

DE 19 15 045 * 10/1970 ..... 42/1.08

* cited by examiner

*Primary Examiner*—Stephen M. Johnson
(74) *Attorney, Agent, or Firm*—Robert M. Downey, P.A.

(57) ABSTRACT

A sprayer device mounts to the barrel of a firearm and includes a housing having forward and rear portions which hold opposite ends of a spray canister containing a pressurized charge of a debilitating chemical substance. The forward and rear portions are adjustably positionable along an elongate brace for accommodating a variety of spray canister sizes. When held between the forward and rear portions of the housing, a nozzle stem of the spray canister is positioned for engagement with a front cap of the housing in axial alignment with a discharge aperture. A trigger actuator on the rear portion is operable to urge the spray canister forward relative to the housing so that the nozzle stem is depressed against the front cap, thereby causing release of the debilitating chemical substance through the discharge aperture in a forward trajectory.

10 Claims, 2 Drawing Sheets

GUN MOUNTED SPRAYER

BACKGROUND OF THE INVENTION

1. Field of the Invention

The present invention relates to a device for mounting a spray canister to a firearm and, more particularly, to a device which mounts to the barrel of a firearm for holding a variety of sizes of spray canisters containing debilitating chemical agents, wherein the device includes means for triggering release of the chemical agents from the canister and in a direction in which the firearm is aimed.

2. Discussion of the Related Art

There are times when law enforcement personnel (i.e. police, FBI agents, ATF agents, SWAT teams and the like) are required to draw a firearm when attempting to apprehend potentially dangerous criminal suspects. In these circumstances, it is not unusual for a suspect to attempt to allude or resist arrest by using non-lethal force. In this situation, the law enforcement officer is not permitted to fire his weapon or to use any type of deadly force. However, because the manner in which a suspect may react is unknown, law enforcement personnel must always be ready to respond with a variety of offensive and defensive tactics. The ability to quickly respond and adjust to both non-lethal resistance as well as the immediate threat of serious bodily harm or death is essential to protect the life of the officer as well as the lives of any victims or innocent bystanders.

In the past, various devices and methods have been proposed for debilitating a criminal suspect by means other than use of a deadly firearm. Examples include the use of non-penetrating projectiles, such as rubber bullets, which cause severe pain and temporary immobility when they strike certain areas of the body. However, use of such projectiles can result in serious injury, such as blindness, and, in many states, are considered to be use of deadly force.

Others have proposed use of various chemical substances, such as tear gas and mace, to temporarily debilitate a suspect without the use of deadly force. In many instances, the chemical debilitating agent is contained within a canister that is secured to the law enforcement officer's belt. When the occasion arises when it is necessary to use the chemical debilitating agent, it can be difficult to quickly and effectively remove the hand held chemical spray device, especially if the law enforcement officer is holding a firearm. This present the danger of a suspect quickly charging the law enforcement officer before the officer has sufficient time to remove the spray canister device from a belt holster. Also, in the haste to quickly remove the chemical agent spraying device, the officer may accidentally drop the canister, thereby providing an opportunity to the suspect to physically attack the officer.

To address the need for law enforcement personnel to be able to quickly respond to the use of non-lethal force when holding a firearm, others have proposed attachment of various spray devices to the firearm. In particular, U.S. Pat. Nos. 5,983,548 and 5,671,559, disclose a non-lethal firearm device wherein a lethal gun, pistol or rifle that conventionally fires solid projectiles in the form of bullets, is converted to a non-lethal defensive weapon by means of a novel canister unit attachment which has the ability to deploy a non-lethal chemical fluid such as tear gas or pepper gas. While the devices disclosed in these patents are far more effective in allowing law enforcement personnel to quickly choose between lethal or non-lethal action as compared to various other methods and devices proposed in the art, they too have several short comings which limit their use and effectiveness. In particular, the non-lethal firearm devices disclosed in these patents are specifically structured for attachment to a specific firearm. Accordingly, they are not readily adaptable to a broad range of firearms, including numerous rifle designs and pistol designs, which may be used by different branches of law enforcement. Further, it these devices require numerous parts, thereby making them expensive and complicated to use. Further, the devices in these patents do not accommodate for various size cartridges, rather they are designed for a specific type of cartridge which may not be readily available to law enforcement personnel or other users of the device. Finally, the non-lethal firearm devices in these patents require operation of a trigger using the same hand and finger which is used to operate the lethal, bullet-firing weapon. This arrangement has the potential to lead to mistakes or accidents wherein the operator may inadvertently pull the wrong trigger, causing a bullet to be fired from the weapon. Finally, the devices in these patents fail to provide a backup should the trigger mechanism used to activate launch of the propellant fail.

Accordingly, there remains an urgent need in the law enforcement community for a highly reliable, effective and readily adaptable device which enables mounting a various size debilitating chemical dispensing canisters to a firearm so that a law enforcement officer can quickly and reliably discharge the chemical debilitating agent at a hostile suspect without the use of deadly force, and yet allowing the officer to quickly switch to the use of deadly force should that be necessary.

OBJECTS AND ADVANTAGES OF THE INVENTION

With the foregoing in mind, it is a primary object of the present invention to provide a device for attachment to an existing firearm to provide the user of the firearm with the option of using non-deadly force in order to debilitate a hostile subject.

It is a further object of the present invention to provide a device for mounting a spray canister containing a debilitating chemical agent to a firearm in order to provide the user of the firearm with the ability to quickly respond and adjust to both non-lethal resistance as well as the immediate threat of serious bodily harm or death.

It is still a further object of the present invention to provide a device for mounting a spray canister containing a debilitating chemical substance to a firearm, wherein the device includes means for triggering release of the chemical substance in a direction in which the firearm is aimed.

It is still a further object of the present invention to provide a device which mounts to a firearm and which provides for means for selectively actuating release of a debilitating chemical substance towards a hostile subject while aiming the firearm at the hostile subject.

It is yet a further object of the present invention to provide a device for mounting a spray canister containing a debilitating chemical agent to the barrel of a firearm, and wherein the device is adjustable to accommodate a variety of size canisters containing the debilitating chemical substance.

It is still a further object of the present invention to provide a device for mounting a spray canister containing a debilitating chemical substance to a firearm, and wherein the device is adapted for mounting to a variety of firearms, including different makes and styles of rifles and handguns.

It is still a further object of the present invention to provide a device for mounting a spray canister containing a debilitating chemical substance to a firearm, and wherein the spray canister is at least partially exposed, thereby permitting the user to grasp the canister to actuate release of the debilitating chemical substance in the event of trigger actuator failure.

It is yet a further object of the present invention to provide a device for mounting a spray canister containing a debilitating chemical substance to a firearm, and wherein the device operate independently of the firearm to provide for selective release of the debilitating chemical substance as an alternative to use of the deadly force of the firearm.

These and other objects and advantages of the present invention are more readily apparent with reference to the detailed description and accompanying drawings.

SUMMARY OF THE INVENTION

The present invention is directed to a device which readily mounts to a variety of firearms, including rifles and handguns. The device includes a housing having a forward portion and a rear portion adjustably positionable along an elongate brace. The forward and rear portions hold opposite ends of a spray canister containing a pressurized charge of a debilitating chemical substance. When supported within the housing of the device, a nozzle stem of the spray canister is positioned for engagement with a front cap of the forward portion in axial alignment with a discharge aperture formed through the front cap. Adjustable positioning of the forward and rear portions on the elongate brace allows for use of a variety of size spray canisters.

A trigger actuator on the rear portion of the housing is operable to urge the spray canister forward, relative to the housing, so that the nozzle stem of the canister is depressed against the front cap, thereby actuating release of the debilitating chemical substance through the discharge aperture in a direction in which the firearm is aimed. Brace means are provided for mounting the device to various barrel sizes and configurations of rifles and handguns.

BRIEF DESCRIPTION OF THE DRAWINGS

For a fuller understanding of the nature of the present invention, reference should be made to the following detailed description taken in conjunction with the accompanying drawings in which.

DETAILED DESCRIPTION OF THE PREFERRED EMBODIMENTS

Referring to the several views of the drawings, the spray canister holder and dispenser device of the present invention is shown and is generally indicated as 10. The device 10 mounts to the underside of the barrel structure of a firearm F as shown in FIGS. 1 and 2.

Figures 1, 2:
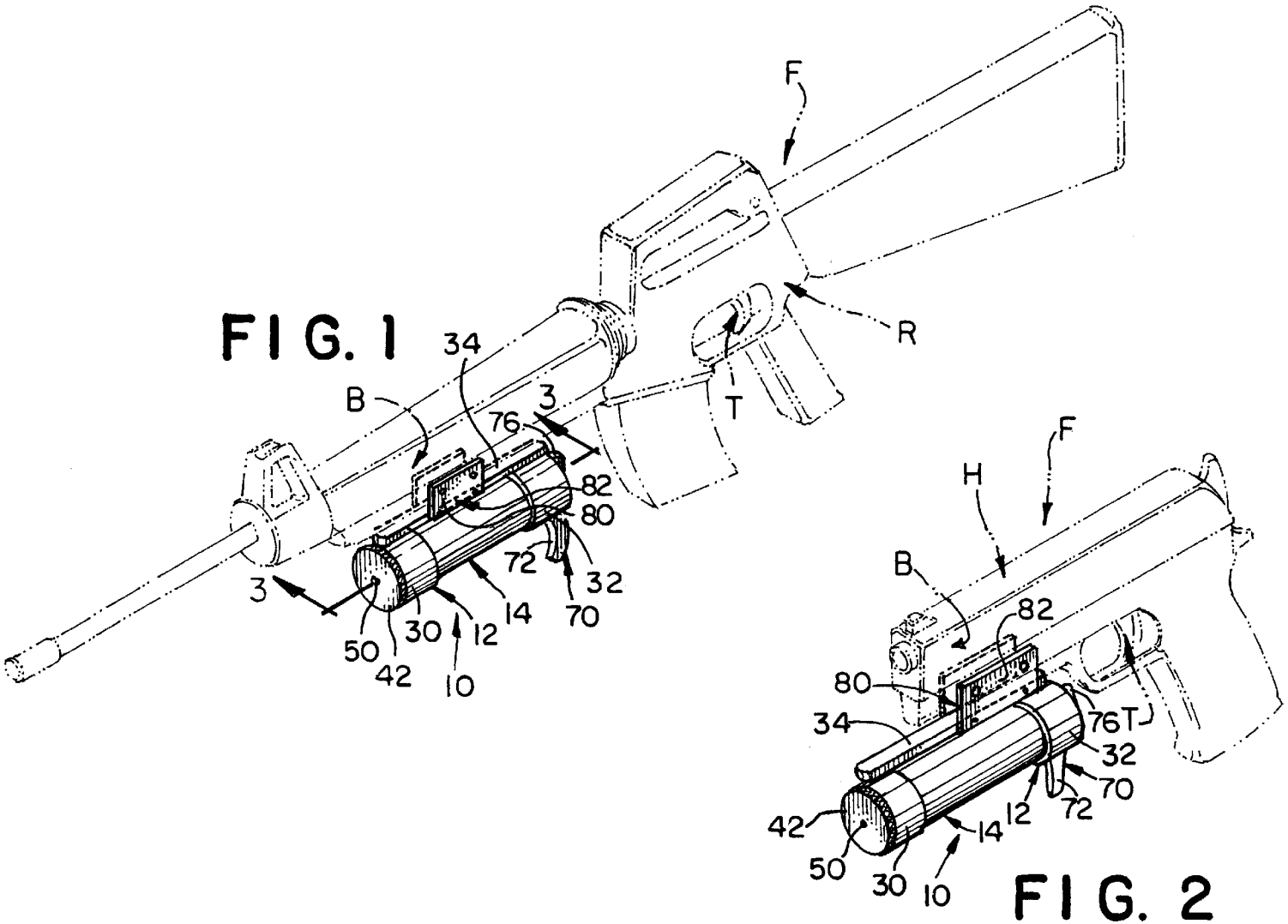
FIG. 1 is a front top perspective view showing the device of the present invention holding a pressurized spray canister and mounted to the barrel structure of a rifle, forward of the rifle's trigger, and wherein the structure of the rifle is indicated in phantom.
FIG. 2 is a top front perspective view showing the device of the present invention holding a pressurized spray canister and mounted to the underside of the barrel structure of a handgun, and wherein the structure of the handgun is illustrated in phantom.

Referring initially to FIG. 1, the device 10 is shown mounted to the underside of the barrel structure B of an assault rifle R, forward of the trigger T of the rifle R.

Figure 3:
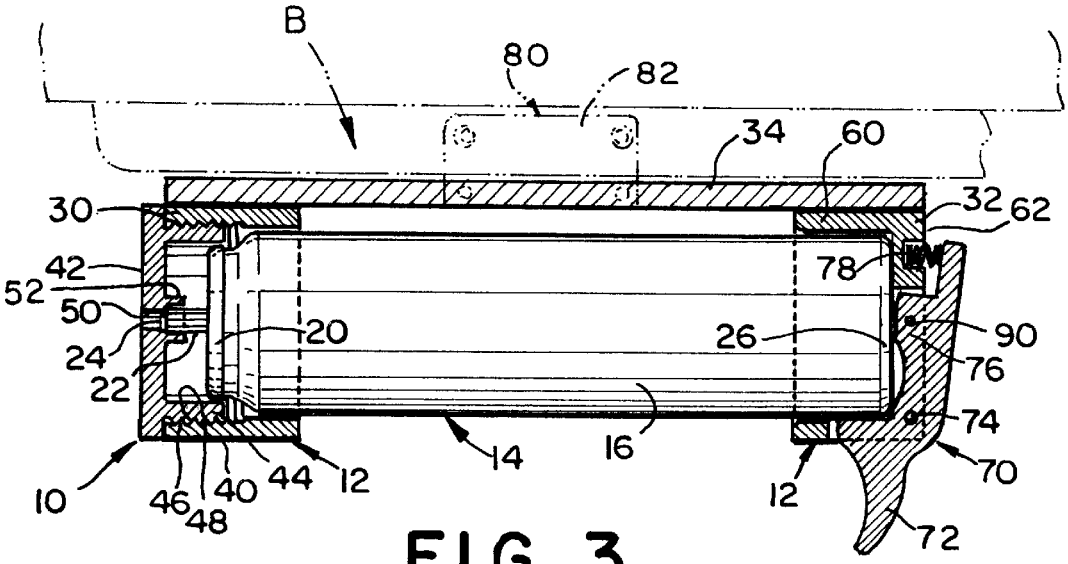
FIG. 3 is a sectional view taken along the plane indicated by the arrows 3—3 in FIG. 1.
Figure 4:
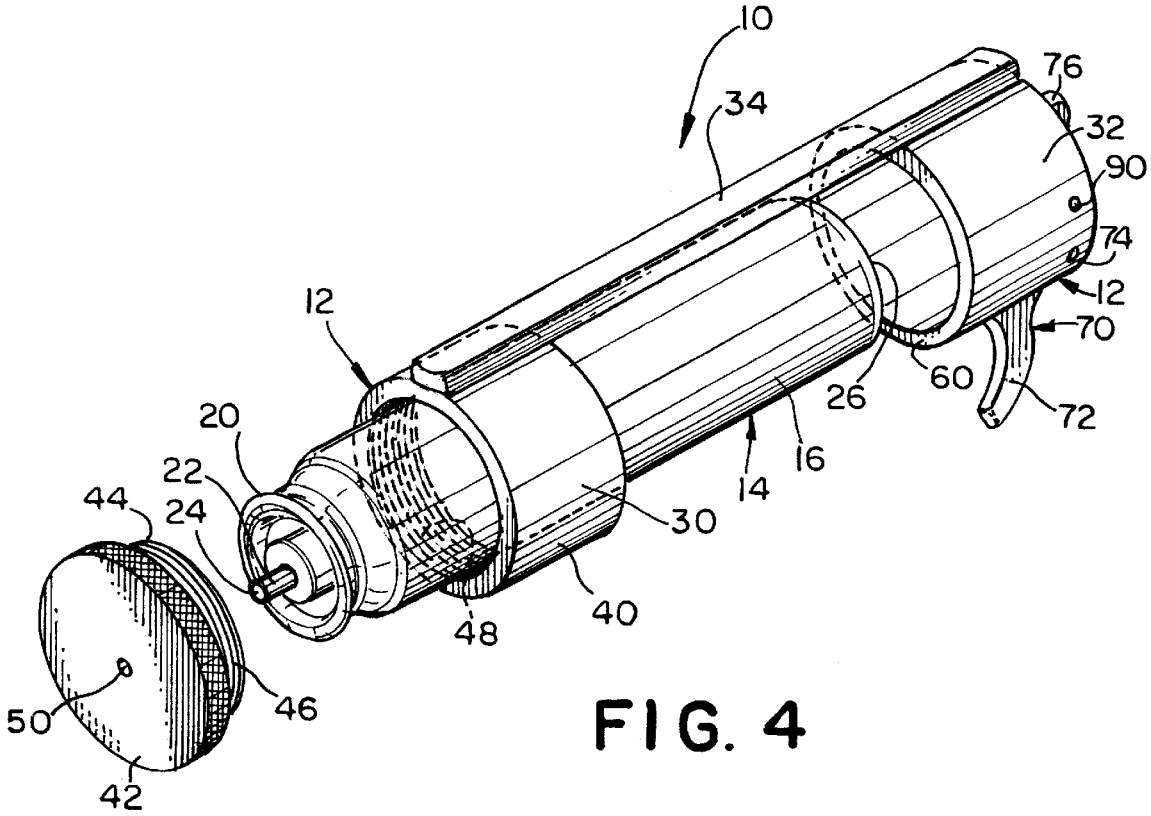
FIG. 4 is an exploded perspective view showing a spray canister containing a pressurized charge of debilitating chemical substance being inserted within the housing of the device of the present invention, with a cap of the housing shown removed to permit insertion and removal of the spray canister within the housing.

Referring now to FIGS. 1, 3 and 4, the device 10 includes a housing 12 for holding the pressurized canister 14. The canister 14 is of a type which is commonly available on the market for self defense and law enforcement use and may contain any of a variety of debilitating chemical substances such as, but not limited to, mace, pepper spray, or tear gas. The canister 14 includes an outer cylindrical body 16 with a top end 20 and a bottom end 26. A nozzle stem 22 extends from the top fit end 20 and communicates with an internal valve within the canister. Upon depressing the nozzle stem 22 inwardly, the valve within the canister is opened, thereby causing release of the pressurized contents of the canister from the tip 24 of the nozzle stem 22. This type of stem valve actuator is well known and can be found on most canisters which contain aerosol or other pressurized propellants for discharging a product packaged in the canister.

The housing 12 of the device includes a forward portion 30 and a rear portion 32. The forward and rear portions 30, 32 are adjustably fitted to an elongate brace 34, near opposite ends thereof, so that the elongate brace 34 spans between the spaced apart forward and rear portions 30, 32. Means for adjustably fitting the forward and rear portions to the elongate brace bar may include a series of apertures 36 arranged at spaced intervals at opposite ends of the elongate brace bar and screws 38 for fastening through the apertures 36 and an adjustably aligned threaded screw hole formed in the forward and rear portions. By moving the forward and/or rear portion along the length of the elongate brace and aligning the threaded screw hole in the forward or rear portion with the desired aperture 36 in the elongate brace, the distance between the forward and rear portions can be adjusted to accommodate various size canisters 14. The forward and rear portions 30, 32 are specifically structured and disposed for holding the opposite ends of the canister 14, so that the canister is maintained below and generally parallel to the barrel of the firearm, as seen in FIGS. 1 and 2.

The forward portion 30 of the housing 12 includes a cylindrical wall 40 which defines a collar having an inside diameter which is slightly greater than the outer diameter of the cylindrical 16 of the canister 14. A front cap 42 removably attaches to the cylindrical wall 40. More specifically, an annular rim 44 on the inside face of the cap 42 is provided with threads 46 which are structured and disposed for threaded engagement with corresponding threads 48 on the inner surface of the cylindrical wall 40, as best seen in FIG. 3. The front cap 42 includes a central aperture 50 formed therethrough. A seat 52 surrounds the central aperture 50 on an inner face of the front cap 42, for receipt of the nozzle stem 22, so that the stem tip 24 aligns with the central aperture 50 when the canister 14 is received within the housing 12 and the front cap 42 is threadably fastened to the front cylindrical wall 40.

The rear portion 32 of the housing 12 includes a cylindrical wall 60 which, like the front cylindrical wall 40, includes an inner diameter which is slightly greater than the outer diameter of the cylindrical body 16 of the canister 14. A rear wall 62 is integrally formed with the cylindrical wall 60, thereby partially enclosing a cavity for receiving the bottom end 26 of the canister 14. Thus, when the canister 14 is received within the housing 12, the nozzle stem tip 24 is firmly seated within the seat 52 on the front cap 42 and the bottom end 26 of the canister 14 is seated against the inner surface of the rear end wall 62 of the rear portion 32 of the housing.

Referring to FIG. 3, an actuator 70 is provided on the rear portion 32 of the housing for actuating release of the pressurized contents within the canister 14. More particularly, the actuator 70 is structured and disposed to urge the entire canister body forwardly within the housing 12, so that the nozzle stem tip 24 is pressed against the seat 52. Continued forward movement of the canister housing results in the nozzle stem 22 being depressed inwardly within the canister, thereby opening the internal valve to release the pressurized contents from the nozzle stem tip 24 and outwardly through the central aperture 50 of the front cap 42 in a forward direction and generally parallel to the line of site of the barrel B of the firearm F. In a preferred embodiment, the actuator 70 includes a trigger 72 and an integral hammer 76. The trigger and hammer are moveable about a pivot 74 so that upon pulling the trigger 72, using a single finger, the hammer 76 moves forwardly against the bottom end 26 of the canister 14, thereby forcing the canister 14 forwardly within the housing 12 to actuate release of the pressurized contents therefrom. A spring biasing element 78 urges the hammer 76 rearwardly to a relaxed position, as seen in FIG. 3, to thereby release forward pressure on the bottom end 26 of the canister 14 so that discharge of the pressurized contents of the canister is interrupted. A removable locking pin 90 is received through the rear end wall 62 and through the hammer 76, to hold the hammer in the relaxed position, thereby preventing accidental release of the pressurized contents from the canister 14 in the event the trigger 72 is inadvertently bumped or pulled.

A bracket 82 attaches to the elongate brace 34 and is structured for removable attachment to the underside of the barrel structure B of the firearm F. The specific bracket design may vary according to the particular structure of the firearm F. Moreover, the bracket 82 may be made to be adjustable, to accommodate various styles and sizes of barrel structures of firearms, including rifles and handguns.

While the instant invention has been shown and described in accordance with preferred and practical embodiments thereof, it is recognized that departures from the instant disclosure are contemplated within the spirit and scope of the invention which, therefore, should not be limited except as set forth in the following claims as interpreted under the doctrine of equivalents.

What is claimed is:

1. A device for use on a firearm which has a barrel and a trigger, said device comprising:

a canister containing a pressurized charge of a debilitating substance, said canister including a main body with a top end and a bottom end, and a nozzle stem extending from the top end and terminating at a distal tip, and wherein the pressurized charge of debilitating substance is released under force from said distal tip of said nozzle stem upon depressing said nozzle stem inwardly into said top end of said canister;

a housing for holding said canister and including:

a forward portion with a front cap and a discharge opening formed through said front cap;

a rear portion with an end wall;

means for supporting said forward and rear portions relative to one another so that said top end of said canister is held within said forward portion with said distal tip of said nozzle aligned with said discharge opening in said front cap and said bottom end of said canister is held against said end wall of said rear portion;

actuator means for urging said canister forward relative to said housing so that said distal tip of said nozzle stem is forced against said front cap and said nozzle stem is depressed, thereby actuating release of the pressurized charge of debilitating substance from said discharge opening;

means for adjustably positioning said forward and rear portions of said housing relative to one another for accommodating variations in size of said canister; and means for removably mounting said device to the barrel of the firearm forward of the trigger so that the release of the pressurized charge of debilitating substance is in a direction of the aim of the barrel of the firearm.

2. The device as recited in claim 1 wherein said housing further comprises a valve seat on said front cap surrounding said discharge opening, said valve seat being structured and disposed for receipt of said distal tip of said nozzle stem in axial alignment with said discharge opening upon operation of said actuator means and depression of said nozzle stem.

3. The device as recited in claim 1 wherein said front cap is structured and disposed for removable attachment to said forward portion of said housing to permit removal and insertion of said canister within said housing.

4. The device as recited in claim 1 wherein said actuator means comprises:

a trigger operable by one or more fingers;

a hammer pivotally moveable from a relaxed position to an actuating position wherein said hammer is forced against said bottom end of said canister to force said canister forwardly within said housing upon operation of said trigger; and biasing means for urging said hammer to said relaxed position defined by said hammer releasing forced pressure against said bottom end of said canister to interrupt discharge of the pressurized charge of debilitating substance from said discharge opening.

5. A device for mounting a canister containing a pressurized charge of a debilitating substance to a firearm, wherein the canister includes a top end, a bottom end, and a nozzle stem extending from the top end and terminating at a distal tip, and wherein the pressurized charge of debilitating substance is released under force from said distal tip of said nozzle stem upon depressing said nozzle stem inwardly into said top end of said canister, said device comprising:

a housing for holding said canister, said housing including a forward portion with a front cap and a discharge opening formed through said front cap, and a rear portion with an end wall;

means for supporting said forward and rear portions relative to one another so that said top end of said canister is held within said forward portion with said distal tip of said nozzle aligned with said discharge opening in said front cap and said bottom end of said canister is held against said end wall of said rear portion;

actuator means for urging said canister forward relative to said housing so that said distal tip of said nozzle stem is forced against said front cap and said nozzle stem is depressed, thereby actuating release of the pressurized charge of debilitating substance from said discharge opening;

means for adjustably positioning said forward and rear portions of said housing relative to one another for accommodating variations in size of said canister; and means for removably mounting said device to the barrel of the firearm forward of the trigger so that the release of the pressurized charge of debilitating substance is in a direction of the aim of the barrel of the firearm.

6. The device as recited in claim 5 wherein said housing further comprises a valve seat on said front cap surrounding said discharge opening, said valve seat being structured and disposed for receipt of said distal tip of said nozzle stem in axial alignment with said discharge opening upon operation of said actuator means and depression of said nozzle stem.

7. The device as recited in claim 5 wherein said front cap is structured and disposed for removable attachment to said forward portion of said housing to permit removal and insertion of said canister within said housing.

8. The device as recited in claim 5 wherein said actuator means comprises:

a trigger operable by one or more fingers;

a hammer pivotally moveable from a relaxed position to an actuating position wherein said hammer is forced against said bottom end of said canister to force said canister forwardly within said housing upon operation of said trigger; and biasing means for urging said hammer to said relaxed position defined by said hammer releasing forced pressure against said bottom end of said canister to interrupt discharge of the pressurized charge of debilitating substance from said discharge opening.

9. A device for mounting a canister to a firearm, wherein the canister contains a pressurized charge of a debilitating substance, and further wherein the canister includes a top end, a bottom end, and a nozzle stem extending from the top end and terminating at a distal tip, and wherein the pressurized charge of debilitating substance is released under force from said distal tip of said nozzle stem upon depressing said nozzle stem inwardly into said top end of said canister, said device comprising:

a housing for supporting the canister;

actuator means for actuating release of the pressurized charge of debilitating substance from the canister;

means for adjustably arranging said housing for accommodating variations in size of said canister; and means for removably mounting said housing to the firearm so that the release of the pressurized charge of debilitating substance is in a direction of the aim of the firearm.

10. The device as recited in claim 9 wherein said actuator means comprises:

a trigger operable by one or more fingers;

a hammer pivotally moveable from a relaxed position to an actuating position wherein said hammer is forced against the bottom end of the canister to force the canister forwardly within said housing upon operation of said trigger; and biasing means for urging said hammer to said relaxed position, wherein said relaxed position is defined by said hammer releasing forced pressure against the bottom end of the canister to interrupt discharge of the pressurized charge of debilitating substance from the canister.

* * * * *